US011397017B2

(12) United States Patent
Uselton

(10) Patent No.: US 11,397,017 B2
(45) Date of Patent: Jul. 26, 2022

(54) SYSTEM AND METHOD FOR SEALING AND SUPPORTING EXTERNAL PIPE CONNECTIONS IN FLUID LINES AND DIRECTING ESCAPED FLUIDS TO A CABINET IN AN HVAC SYSTEM

(71) Applicant: Lennox Industries Inc., Richardson, TX (US)

(72) Inventor: Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 260 days.

(21) Appl. No.: 16/580,052

(22) Filed: Sep. 24, 2019

(65) Prior Publication Data

US 2021/0088242 A1 Mar. 25, 2021

(51) Int. Cl.

| | |
|---|---|
| ***F24F 11/36*** | (2018.01) |
| ***F24F 1/0068*** | (2019.01) |
| ***F24F 1/32*** | (2011.01) |
| ***F24F 1/34*** | (2011.01) |
| ***F24F 1/0326*** | (2019.01) |
| ***F24F 1/022*** | (2019.01) |

(52) U.S. Cl.

CPC ..... *F24F 11/36* (2018.01); *F24F 1/0068* (2019.02); *F24F 1/022* (2013.01); *F24F 1/0326* (2019.02); *F24F 1/32* (2013.01); *F24F 1/34* (2013.01); *F25B 2500/22* (2013.01)

(58) Field of Classification Search

CPC ..... F24F 1/34; F24F 1/0068; F24F 1/0326; F24F 1/32; F25B 2500/22

See application file for complete search history.

(56) References Cited

U.S. PATENT DOCUMENTS

| | | | | |
|---|---|---|---|---|
| 3,999,785 | A * | 12/1976 | Blakeley | F16L 41/12 285/111 |
| 7,484,379 | B2 * | 2/2009 | Shibata | B60H 1/00521 62/222 |
| 9,279,532 | B2 * | 3/2016 | McAtarian | F16L 55/07 |
| 10,670,177 | B2 * | 6/2020 | Borawski | F16L 25/06 |

* cited by examiner

*Primary Examiner* — Lionel Nouketcha
(74) *Attorney, Agent, or Firm* — Baker Botts L.L.P.

(57) ABSTRACT

A stub pipe housing and a method for installing a stub pipe housing in a heating, ventilation, and air conditioning ("HVAC") system, the stub pipe housing comprising a first end for sealed contact with an external surface of a cabinet in the HVAC system and a non-permeable material extending to a second end for sealed contact with an external pipe. Sealed contact between the first end and the cabinet, sealed contact between the second end and the external surface, and the non-permeable material ensures any fluid escaping the connection between the stub pipe and the external pipe is directed to the cabinet. The stub pipe housing supports the connection using resilient material, rigid material with compliant seals or some combination. Fluids are directed to flow through the stub pipe opening in the cabinet or directed to flow through other openings.

19 Claims, 4 Drawing Sheets

SYSTEM AND METHOD FOR SEALING AND SUPPORTING EXTERNAL PIPE CONNECTIONS IN FLUID LINES AND DIRECTING ESCAPED FLUIDS TO A CABINET IN AN HVAC SYSTEM

TECHNICAL FIELD

This disclosure relates generally to heating, ventilation and air conditioning (HVAC) systems such as heat pumps and air handling systems. More specifically, this disclosure relates to a system and method for sealing external pipe connections to prevent fluid leakage and ensuring all system fluids remain contained within the system.

BACKGROUND

Heating, ventilation, and air conditioning ("HVAC") systems can be used to regulate the environment within an enclosed space. Frequently, components are housed in a cabinet to protect the components and to present a more aesthetically appearance for customers, and a technician brazes connections between external pipes to stub pipes extending from the HVAC cabinet to interconnect internal components with other equipment in the HVAC system.

SUMMARY OF THE DISCLOSURE

HVAC systems rely on pressure and temperature differentials related to refrigerants in a refrigeration cycle to efficiently heat and cool air. Traditional refrigerants, although great for the HVAC system, have been scrutinized for their impact on the environment and are presently being replaced by newer refrigerants called A2L refrigerants. New Underwriter Laboratories (UL) safety standards are being updated with requirements to address the use of A2L refrigerants in air conditioning and refrigeration systems. While these new refrigerants may be beneficial to the environment, they also present an increased flammability risk. A proposed regulation would require all connections be contained within the confines of an HVAC cabinet, where sensors and mitigation systems can be implemented to address the flammability risk. However, this proposed solution is likely to cause cabinets to be larger to accommodate the connections and the additional sensors and mitigation systems for the A2L refrigerants. In certain placements, this proposed solution will require modification of an area in which an older HVAC system is replaced and/or will require modification of existing fluid lines and structures through which fluid lines run.

Embodiments disclosed herein are generally directed to system and methods for sealing external pipe connections in HVAC systems and ensuring any fluid that escapes near the connection is directed into a cabinet to facilitate detection and mitigation of risks related to the presence of the fluids.

Embodiments disclosed herein are generally directed to a stub pipe housing for preventing fluid escaping a connection in a fluid line. The stub pipe housing has a first end for sealed contact with a cabinet and a second end configured for sealed contact with an external pipe connected to the stub pipe. The first end comprises an inner diameter greater than at least an opening for a stub pipe extending from the cabinet and the stub pipe housing comprises a non-permeable inner surface formed between the first end and the second end such that the sealed contact between the first end and the cabinet, the sealed contact between the second end and the external pipe and the non-permeable inner surface of the stub pipe housing direct fluid escaping the connection into an opening in the cabinet. In some embodiments, the first end comprises a flange extending radially outward as a surface and the stub pipe extends through a stub pipe opening in the cabinet such that sealed contact between the stub pipe housing and the cabinet comprises contact between the surface of the flange and an external surface of the cabinet. The sealed contact between the flange and the external surface of the cabinet, the sealed contact between the second end and the external pipe and the non-permeable inner surface of the stub pipe housing direct fluid escaping the connection into an opening in the cabinet. In some embodiments, the first end comprises a flange extending radially outward as an edge and the stub pipe extends through a stub pipe opening in the cabinet such that sealed contact between the stub pipe housing and the cabinet comprises contact between the edge of the flange and an external surface of the cabinet. The sealed contact between the flange and the cabinet comprises a seal positioned in the stub pipe opening and the edge of the flange seated in the seal. In some embodiments, the stub pipe extends through a first opening in the cabinet, the external surface comprises a second opening separate from the first opening and the first end of the stub pipe housing comprises an inner diameter adapted for sealed contact with an external surface of the cabinet relative to one or more of the first opening and the second opening. In some embodiments, the non-permeable inner surface comprises an elastomeric material. In some embodiments, the second end comprises one of a compliant seal formed with an inner diameter less than an outer diameter of the external pipe, a compliant seal and hardware for clamping the compliant seal to the external pipe, or a compliant seal and a circumferential groove or rib for seating the compliant seal against the external pipe. In some embodiments, the stub pipe housing comprises a rigid material and the second end comprises a compliant seal. The stub pipe housing prevents bending at the connection between the stub pipe and the external pipe.

Embodiments disclosed herein are also generally directed to a method for directing fluid escaping a connection between an external pipe and a stub pipe to a cabinet in an HVAC system. The method comprises positioning a stub pipe housing on the external pipe, wherein the stub pipe housing comprises an inner diameter greater than at least an opening for a stub pipe extending from the cabinet and a second end adapted for contact with the external pipe. Once the connection between the stub pipe and the external pipe is formed, the method comprises forming a sealed contact between the first end of the stub pipe housing and the cabinet. The sealed contact between the first end and the cabinet, the sealed contact between the second end and the external pipe and the non-permeable inner surface of the stub pipe housing direct fluid escaping the connection into an opening in the cabinet. In some embodiments, the first end comprises a flange extending radially outward as a surface and the stub pipe extends through a stub pipe opening in the cabinet and sealing the connection comprises coupling the surface of the flange to an external surface of the cabinet. In some embodiments, the first end comprises a flange extending radially outward as an edge, the stub pipe extends through a stub pipe opening in the cabinet and sealing the connection comprises positioning a seal in the stub pipe opening and seating the edge of the flange in the seal. In some embodiments, configuring the stub pipe housing for sealed contact with the external pipe comprises one of positioning the second end on the external pipe, wherein the second end of the stub pipe housing comprises a compliant seal formed with an inner diameter less than an outer diameter of the external pipe, clamping a compliant seal to the external pipe, or seating a compliant seal in a circumferential groove or against a circumferential rib.

Embodiments disclosed herein are also generally directed to an HVAC system with a compressor, an evaporator and a condenser forming a refrigeration cycle and a plurality of fluid lines coupled to the compressor, the evaporator and the condenser, wherein each connection between a fluid line and one of the compressor, the evaporator and the condenser represents a point at which fluid can escape the HVAC system. For each stub pipe in the HVAC system a stub pipe housing is coupled to prevent fluid leakage and to direct any fluids escaping connections between the stub pipes and the external pipes. Each stub pipe housing comprises a first end for sealed contact with a cabinet, wherein the first end comprises an inner diameter greater than at least an opening for a stub pipe extending from the cabinet; and a second end configured for sealed contact with an external pipe connected to the stub pipe. The stub pipe housing comprises a non-permeable inner surface formed between the first end and the second end such that the sealed contact between the first end and the cabinet, the sealed contact between the second end and the external pipe and the non-permeable inner surface of the stub pipe housing direct fluid escaping the connection into an opening in the cabinet. In some embodiments, the first end of at least one stub pipe housing comprises a flange extending radially outward as a surface, the stub pipe extends through a stub pipe opening in the cabinet and sealed contact between the stub pipe housing and the cabinet comprises contact between the surface of the flange and an external surface of the cabinet. In some embodiments, the first end comprises a flange extending radially outward as an edge, the stub pipe extends through a stub pipe opening in the cabinet and sealed contact between the stub pipe housing and the cabinet comprises a seal positioned in the stub pipe opening and the edge of the flange seated in the seal. In some embodiments, the second end comprises one of a compliant seal formed with an inner diameter less than an outer diameter of the external pipe, a compliant seal and hardware for clamping the compliant seal to the external pipe, or a compliant seal and a circumferential groove or rib for seating the compliant seal against the external pipe. In some embodiments, at least one stub pipe housing comprises a rigid material and a respective second end of the stub pipe housing comprises a compliant seal such that coupling the second end of the stub pipe housing to an external pipe prevents bending at the connection between the stub pipe and the external pipe.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

Figure 1:
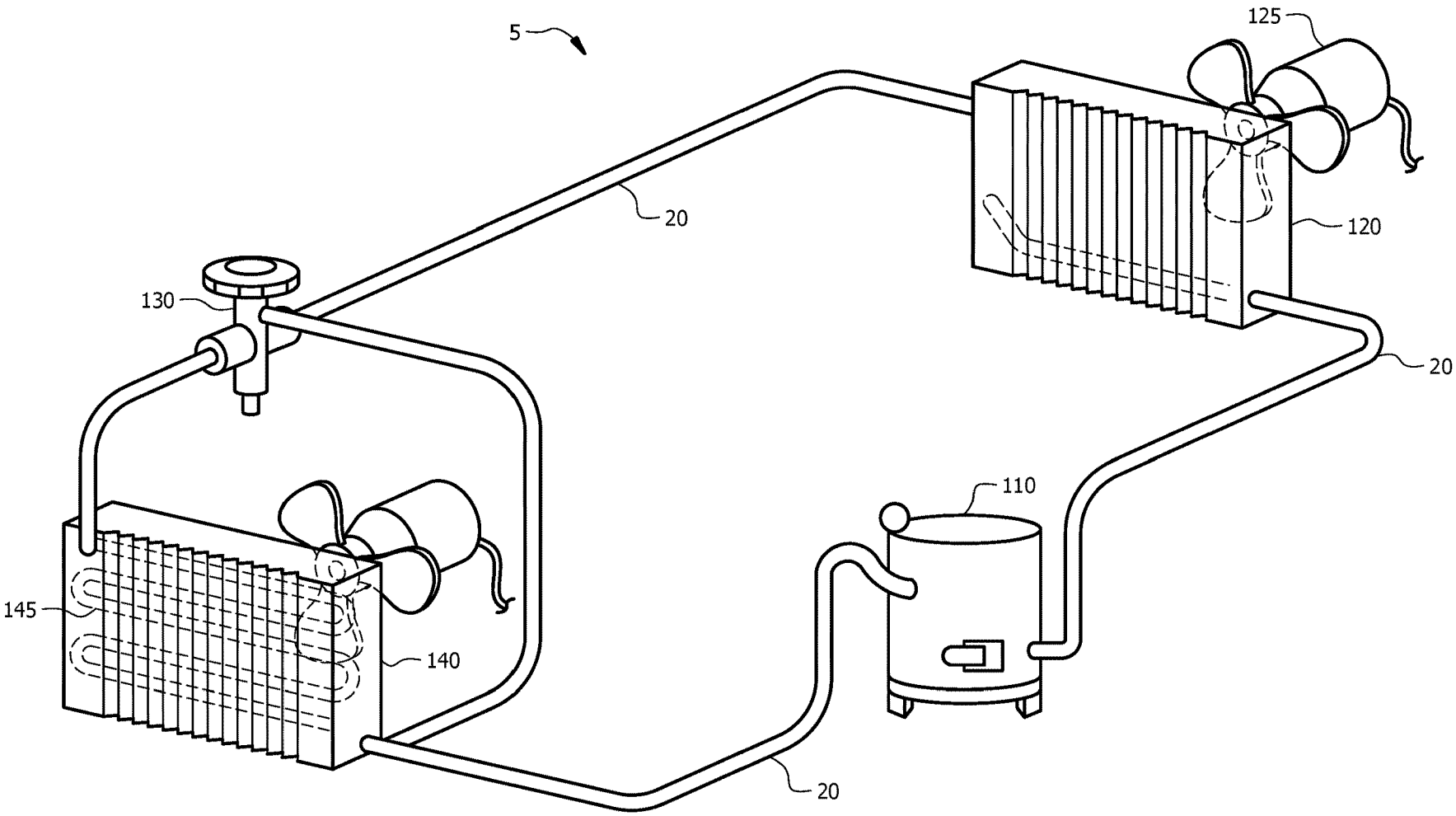
FIG. 1 depicts an architectural diagram of an exemplary heating, ventilation, and air conditioning ("HVAC") system.

FIG. 1 depicts an architectural diagram of an exemplary heating, ventilation, and air condition ("HVAC") system, illustrating a refrigeration cycle. HVAC system 5 includes a compressor 110, a condenser 120, an expansion valve 130 and an evaporator 140. Refrigerant flows through HVAC system 100 undergoing changes to its temperature, pressure, and phase. Compressor 110 receives heated gaseous refrigerant from evaporator 140 and compresses it such that the refrigerant changes phases to become a hot, high-pressure gas. The hot, high-pressure gas refrigerant is discharged from the compressor and received by condenser 120. Fan 125 draws air flow across condenser 120, which condenses the received hot, high-pressure gas into hot, high-pressure liquid. This hot, high-pressure liquid is expelled from condenser 120 to expansion valve 130. Expansion valve 130 allows reduction of the pressure of the refrigerant, thereby producing a combination of refrigerant vapor and cold, low-pressure liquid refrigerant. The cold, low-pressure liquid refrigerant is then directed to evaporator 140 to be used to condition air of an enclosed space. For example, air received from a return duct (not illustrated) is blown over circuits 145 of evaporator 140 through which the cold, low-pressure liquid refrigerant is circulated. Due to heat-exchange principles, heat is transferred from the return air to circuits 145, thereby cooling the air and warming the refrigerant in circuits 145. The cooled air is then directed to the enclosed space and the superheated gaseous refrigerant is expelled to the compressor(s) 110.

Although this disclosure describes and depicts HVAC system 5 including particular components, this disclosure recognizes that HVAC system 5 may include (or exclude) other components. Embodiments of HVAC system 5 are usable in commercial systems or residential systems, and can be part of a split system air conditioning system, a heat pump, or a refrigeration unit for example.

Figure 2:
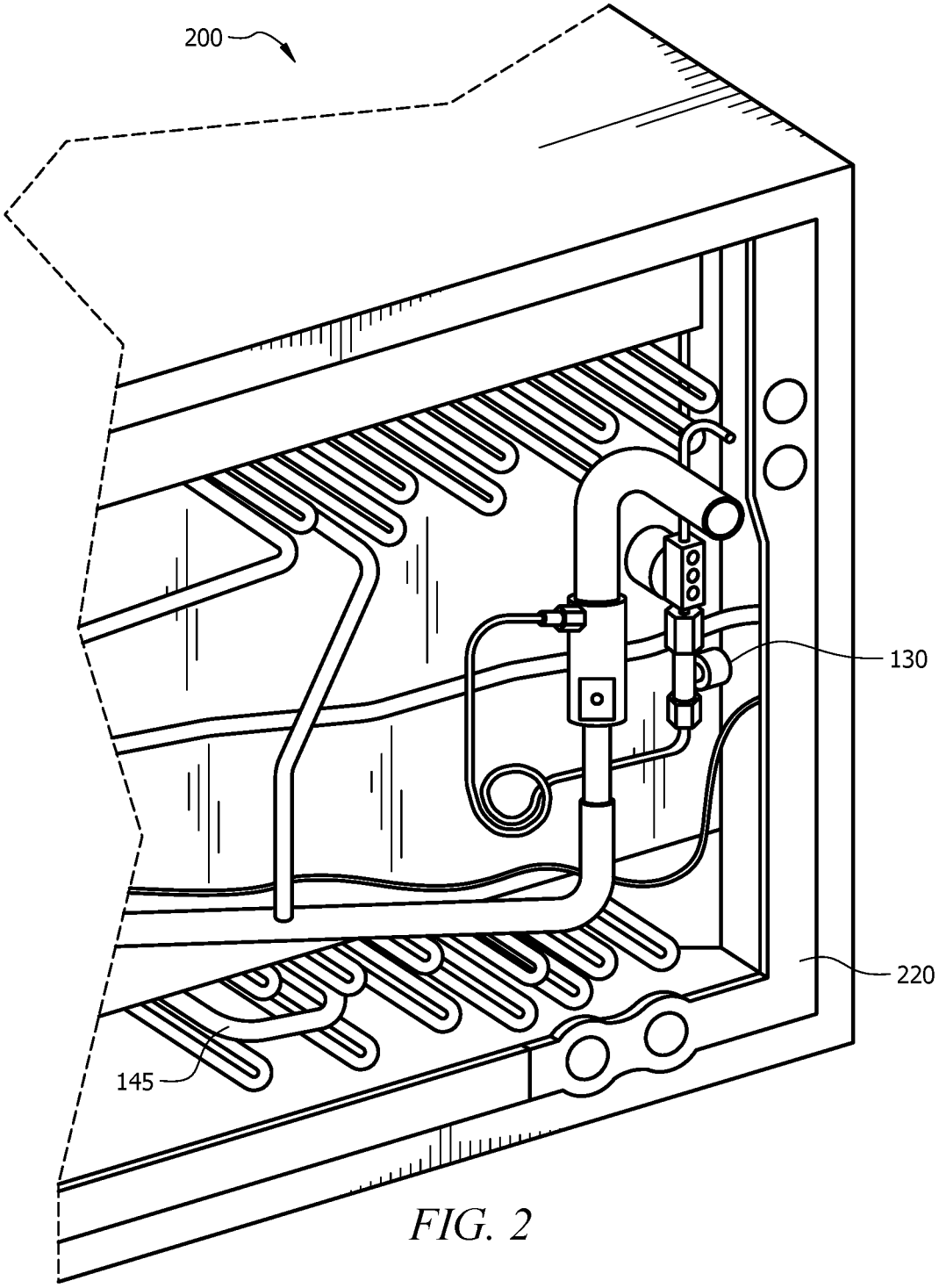
FIG. 2 depicts a perspective view of an exemplary cabinet in an HVAC system, illustrating a positioning of selected HVAC components and their proximity to stub pipes.

When connecting evaporator 140 to fluid lines in a refrigeration cycle, evaporator 140 is typically housed in a cabinet. FIG. 2 depicts a perspective view of an exemplary evaporator cabinet in an HVAC system, illustrating the complexity of HVAC systems and the proximity of internal components to stub pipes. As depicted in FIG. 2, a typical evaporator cabinet 200 is configured to maximize the capacity of the system with a minimal volume, with stub pipes 10 extending from an evaporator 140. To connect evaporator 140 to a fluid line, a technician typically brazes the connections between stub pipes extending from the cabinet and external pipes in the fluid lines. These brazed connections are reliable for preventing fluid leakage from the fluid lines. However, the distance that stub pipes 10 extend from cabinet 200 affects how easily the connections can be brazed. For example, if the stub pipes do not extend (or extend a negligible amount) from a back panel, brazing the connection could damage an expansion valve 130, circuits 145, electronic controls, and sensors that are typically positioned in cabinet 200 with minimal clearance relative to a back panel (not shown) and frame 220. Furthermore, modifying the design of the cabinet to include the connections has drawbacks. For example, making the cabinet larger might require modifications to an environment in which the HVAC cabinet is to be installed, and if the stub pipes are located within the cabinet 200, brazing connections becomes more difficult due to the limited space in the cabinet and the close proximity to the expansion valve 130, circuits 145, electronic controls, and sensors. Even a skilled technician will have more trouble getting a good brazed connection as access to the stub pipes decreases.

Accordingly, embodiments disclosed herein allow technicians to use existing skills for brazing reliable connections between stub pipes and external pipes as a solution for providing safe handling of refrigerants and other fluids. Embodiments can seal an external connection between a stub pipe and an external pipe and support the connection to prevent leakage and, in the event any fluid escapes the connection, these same embodiments can direct fluid to a cabinet for detection and mitigation.

Figure 3:
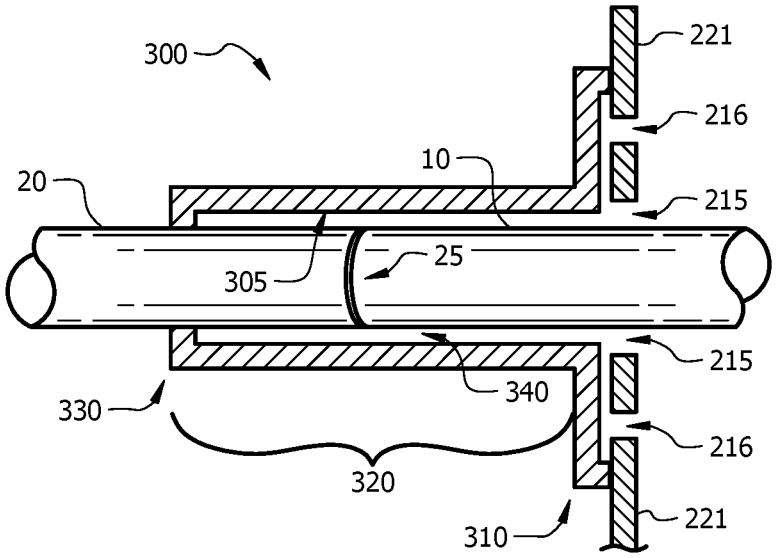
FIG. 3 depicts a cross-section view of one embodiment of a stub pipe housing for preventing fluid from escaping a connection and directing fluid escaping a connection between a stub pipe and an external pipe to a cabinet.

FIG. 3 depicts a cross-section view of one embodiment of a stub pipe housing for sealing an external connection to prevent fluid leakage and directing any fluid that might leak from a connection between a stub pipe and an external pipe to a cabinet. As depicted in FIG. 3, a stub pipe housing 300 comprises end 310 configured for sealed contact with back panel or other external surface 221 of cabinet 200 and an inner surface 305 formed with a non-permeable material extending to end 330 adapted for sealed contact with the external pipe 20 at a distance beyond a connection 25 between a stub pipe 10 and the external pipe 20.

In some embodiments, end 310 comprises a flange configured to surround any openings in cabinet 200. In some embodiments, cabinet 200 comprises only a stub pipe opening 215 and end 310 is configured to surround stub pipe opening 215 such that all fluid escaping from a connection between an external pipe 20 and a stub pipe 10 is contained within volume 340 where it is directed through the stub pipe opening 215 into cabinet 200. In other embodiments, cabinet 200 comprises perforations or other openings 216 and end 310 is configured to surround stub pipe opening 215 and openings 216 such that any fluid escaping the connection is routed through the stub pipe opening 215 or the other openings 216. One or more of openings 215, 216 are formed to allow fluid flow toward a sensor for detecting fluid leaks or a fan or other system for dissipating fluid buildup or otherwise mitigating fluid leaks.

In some embodiments, stub pipe housing 300 is formed with non-permeable material for supporting a connection between an external pipe 20 and stub pipe 10. In some of these embodiments, stub pipe housing 300 is formed with resilient material, wherein end 330 forms sealed contact with external pipe 20. The resilient material determines the amount of support possible by the stub pipe housing 300. Elastomeric materials are examples of a resilient material capable of sealed contact with external pipe 20 and capable of supporting the connection between external pipe 20 and stub pipe 10. In other embodiments, stub pipe housing 300 is formed with rigid material and end 330 is formed with compliant material for sealed contact with external pipe 20. Advantageously, stub pipe housing 300 configured to support the connection between external pipe 20 and stub pipe 10 reduces the likelihood that fluid escapes.

Stub pipe housing 300 is formed to contain any fluid escaping connection between external pipe 20 and a stub pipe 10 and direct the escaped fluid to the cabinet 200. Embodiments of stub pipe housing 300 is formed with a uniform cross-section, graduated cross-section, or stepped cross-section. The size and cross-section can be selected based on the size of external pipe 20 or based on available clearance. For example, a pressurized line typically has a smaller diameter and may be better supported with a stub pipe housing with a more rigid material formed into a smaller cross-section, whereas a return line typically has a larger diameter and may be better supported with a stub pipe housing having a more resilient material but formed with a larger cross-section. In the event fluid does escape from the connection, sealed contact between external pipe 20 and end 330 ensures any fluid leakage is contained within volume 340 of stub pipe housing 300, wherein stub pipe housing 300 directs fluid escaping the connection to flow through opening 215 and/or openings 216 into cabinet 200. In some embodiments, end 330 comprises compliant or elastomeric material.

Figure 4:
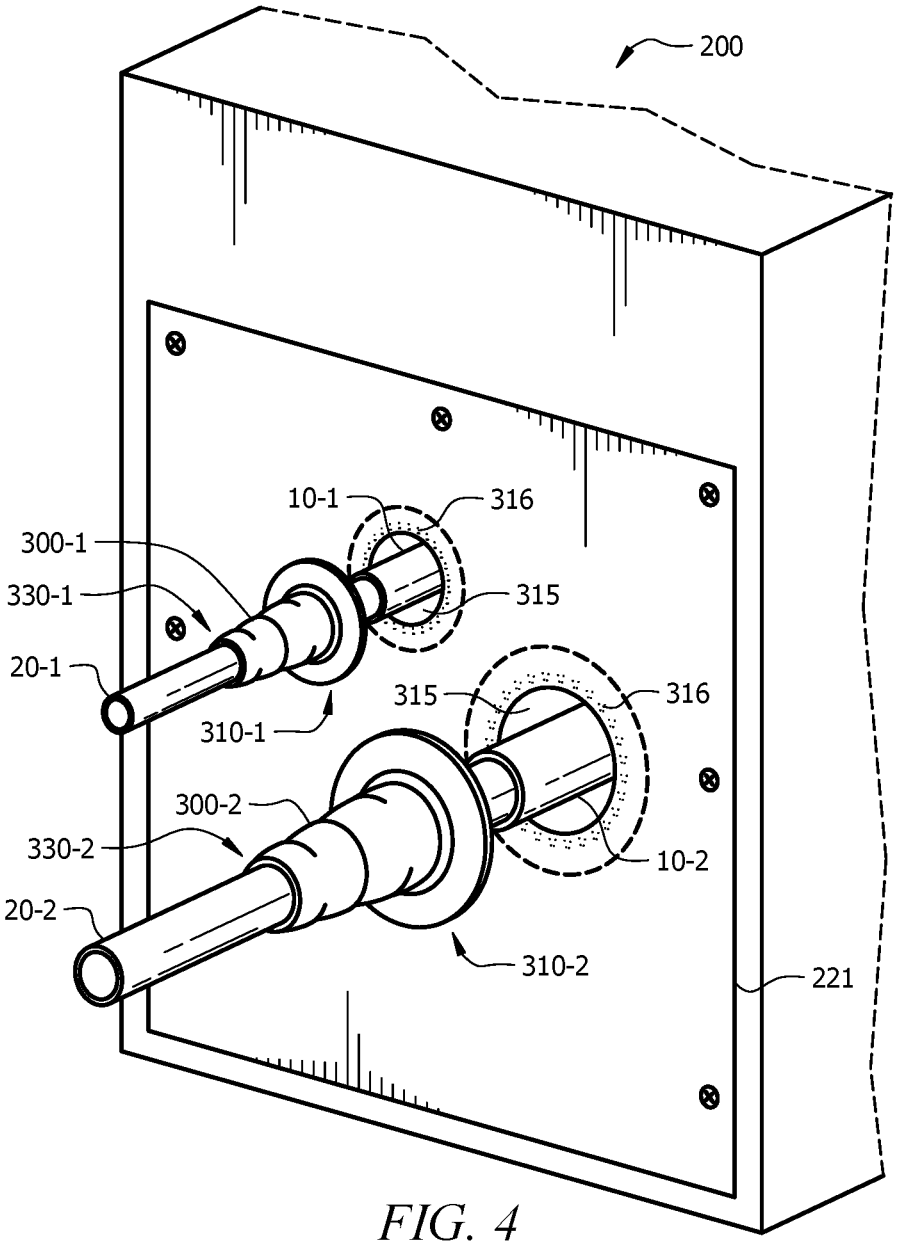
FIG. 4 depicts a perspective view of embodiments of a stub pipe housing relative to an exemplary HVAC cabinet, illustrating a stub pipe housing system capable of supporting external pipes relative to stub pipes to prevent bending of connections between the stub pipes and the external pipes and for directing fluid escaping from the connections to the cabinet.

Embodiments of a system for preventing fluid escaping from any of multiple fluid lines are configured with a stub pipe housing for preventing fluid leakage from a pressurized line and a stub pipe housing for preventing fluid loss from a return or non-pressurized line. FIG. 4 depicts a perspective view of one embodiment of a stub pipe housing system for use in a system such as an HVAC system, in which components can have a high pressure line and a low pressure line. The pressurized line is generally smaller in diameter but has a higher pressure and may have a thicker wall thickness to handle the increased pressure. Embodiments disclosed herein include systems with stub pipe housings capable of supporting external pipes relative to stub pipes for a pressurized line and a non-pressurized line. Each stub pipe housing 300-1, 300-2 is configured to prevent bending of a connection between the stub pipe and the external pipe and for directing fluid escaping from the connection to a cabinet. Furthermore, any material used to form stub pipe housings 300 may be selected to withstand low or high pressures and/or temperatures depending on the position in a refrigeration cycle.

As depicted in FIG. 4, stub pipes 10-1 and 10-2 extend from cabinet 200 for connecting to external pipes 20-1 and 20-2 respectively. To prevent fluid escaping either connection, each connection is protected by a stub pipe housing 300-1 or 300-2. Generally, both stub pipe housings 300-1, 300-2 comprise ends 310-1, 310-2 for sealed contact with cabinet 200 and second ends 20-1 and 20-2 extending a distance beyond connections to external pipes 20-1 and 20-2. However, external pipe 20-1 may be a high pressure line whereas external line 20-2 may be a low pressure line. Accordingly, stub pipe housing 300-1 is formed from a first material with first end 310-1 adapted for sealed contact with a cabinet, wherein stub pipe housing 300-1 extends a first distance to a second end 330-1, and stub pipe housing 300-2 is formed from a second material with first end 310-2 adapted for sealed contact with the cabinet, wherein stub pipe housing 300-2 extends a first distance to a second end 330-2.

Material used to form stub pipe housings 300 depend on the size of the system, fluid pressures in the fluid lines, fluid characteristics in the fluid lines, the environment in which the system is utilized. For example, material used to form a stub pipe housing to protect a connection on a fluid line outside a building may need to function in temperatures below freezing, withstand heat and sunlight, and other weather factors that could degrade material at a faster rate than material used indoors. Material used to form a stub pipe housing to protect a connection on a fluid line in a commercial or manufacturing environment may need to function in areas in which other chemicals are present, HVAC requirements are tightly controlled such that any HVAC system is operating at higher pressures, increased fluid flow rates or other demands on the HVAC system not present in a residential system.

Sealed contact between first end 310-1 or 310-2 and cabinet 200 may be achieved by direct contact between first end 310-1 or 310-2 and an external surface or opening or cabinet 200 or a gasket, seal, o-ring or other intermediate component may be interposed between first end 310-1 or 310-2 and an external surface or opening in cabinet 200 to ensure sealed contact. In some embodiments, first end 310-1 or 310-2 comprises a flange extending radially outward as a surface, wherein sealed contact between the stub pipe housing 300-1 or 300-2 comprises contact between the surface of the flange and the external surface of the cabinet, and hardware or an adhesive is used to ensure sealed contact. In other embodiments, first end 310-1 or 310-2 comprises a flange extending radially outward as an edge, wherein sealed contact between the stub pipe housing 300-1 or 300-2 and the cabinet comprises positioning a seal on the cabinet and seating the flange in the seal.

In some embodiments, supporting a high pressure fluid line comprises limiting the degree angle to which connection 45 can be bent. In various embodiments, stub pipe housing 300-1 is formed as a rigid member to prevent external pipe 20-1 bending relative to stub pipe 10-1. In various embodiments, stub pipe housing 300-1 spans a longer distance across a connection to reduce the angle to which the connection may bend. In various embodiments, sealed contact between a first end 310-1 and cabinet 200 limits the angle to which the connection may bend. For example, embodiments with first end 310-1 formed with a large inner diameter and rigidly coupled to cabinet 200 prevents substantially any bending or rotation of the fluid line and prevents any bending of a connection. In other embodiments, first end 310-1 formed with a small inner diameter and a resilient seal allows some movement or rotation of the fluid line while still preventing bending of the connection.

For a high pressure fluid line, embodiments disclosed herein ensure fluid escaping a connection are directed to cabinet 200. In some embodiments, second end 330-1 comprises a compliant seal that is clamped to external pipe 20 using hardware. In other embodiments, second end 330-1 comprises a compliant seal having an inner diameter slightly smaller than an outer diameter of external pipe 20-1, wherein resistance between the compliant seal and external pipe 20 results in sealed contact between stub pipe housing 300-1 and external pipe 20-1. In some embodiments, external pipe 20 comprises a circumferential groove or rib (not shown), wherein a compliant seal is adapted to seat in the groove or against the rib for sealed contact between stub pipe housing 300-1 and external pipe 20-1.

A low pressure fluid line may have a larger diameter and less pressure and may also have a smaller wall thickness. In some embodiments, supporting a fluid line comprises stabilizing a connection between the external pipe 20 and stub pipe 10 and absorbing vibrations, forces or torques to which the connection may be exposed. In various embodiments, stub pipe housing 300-2 is formed as a resilient member to resist external pipe 20-1 moving or twisting relative to stub pipe 10-1 and absorb vibrations in the HVAC system. In various embodiments, sealed contact between a first end 310-2 and cabinet 200 limits the angle to which the connection external pipe 20 can move or twist relative to stub pipe 10-2. For example, embodiments of stub-pipe housing 300-2 formed from a resilient material having a large wall thickness and rigidly coupled to cabinet 200 prevents substantially any bending or rotation of the fluid line near cabinet 200 and resists bending or twisting of external pipe 20-2 relative to stub pipe 10-2 but allows more freedom at second end 330-2. In other embodiments, stub pipe housing 300-2 formed with a stepped or graduated cross-sectional profile and rigidly coupled to cabinet 200 prevents substantially any bending or rotation of the fluid line near cabinet 200 and resists bending or twisting of external pipe 20-2 relative to stub pipe 10-2 but allows more freedom at second end 330-2. In some embodiments, stub pipe housing 300 is formed from an elastomeric material compound capable of providing support to a connection over a wide range of temperatures and adapted for non-permeability.

For a low pressure line, embodiments disclosed herein ensure fluid escaping a connection are directed to cabinet 200. In some embodiments, second end 330-1 comprises a compliant seal that is clamped to external pipe 20 using hardware. In other embodiments, second end 330-1 comprises a compliant seal having an inner diameter slightly smaller than an outer diameter of external pipe 20-1, wherein resistance between the compliant seal and external pipe 20 results in sealed contact between stub pipe housing 300-1 and external pipe 20-1. In some embodiments, external pipe 20 comprises a circumferential groove or rib (not shown), wherein a compliant seal is adapted to seat in the groove or against the rib for sealed contact between stub pipe housing 300-1 and external pipe 20-1. An advantage to embodiments such as depicted in FIG. 4 include the ability to customize each stub pipe housing 300-1, 300-2 for a particular application. If a stub pipe housing 300-1, 300-2 has an associated sensor for detecting the presence of fluid, an advantage is the ability to determine if fluid is escaping from a connection or from some component in the cabinet, or determine from which connection fluid is escaping in embodiments with multiple sensors.

In various embodiments, portions of stub pipe housing 300-1 and 300-2 are integrated into a single housing 300 (not shown). For example, in some embodiments, stub pipe housing 300 comprises a first end 310 adapted for sealed contact with an external surface of cabinet 200 and having an inner diameter or shape to accommodate both stub pipe openings, wherein any fluid escaping a connection is directed into cabinet 200. In various embodiments, stub pipe housing 300 comprises separate second ends 330-1, 330-2 to accommodate fluid lines of different diameters. Advantages to this design may include the ability to direct fluid escaping from either connection to a single point for detection and the additional support each fluid line can provide for supporting another fluid line.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, refrigeration system may include any suitable number of compressors, condensers, condenser fans, evaporators, valves, sensors, controllers, and so on, as performance demands dictate. One skilled in the art will also understand that refrigeration system 100 can include other components that are not illustrated but are typically included with refrigeration systems. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A stub pipe housing for preventing fluid escaping a connection in a fluid line, comprising:

a first end configured for sealed contact with a cabinet, wherein the first end comprises an inner diameter greater than at least an opening for a stub pipe extending from the cabinet, wherein the first end of the stub pipe housing comprises a flange extending radially outward operable to connect the stub pipe housing to the cabinet, the flange comprising an outward protrusion abutting the cabinet;

a second end configured for sealed contact with an external pipe connected to the stub pipe; and a non-permeable inner surface formed between the first end and the second end;

wherein the external pipe connected to the stub pipe, the non-permeable inner surface, and the sealed contact between the second end and the external pipe define a volume for directing fluid escaping the connection into the opening in the cabinet, wherein at least a portion of the volume is between the external pipe and the stub pipe housing, the opening of the cabinet allowing for fluid communication between the interior of the cabinet and the volume.

2. The stub pipe housing of claim 1, wherein: the stub pipe extends through a first opening in the cabinet; an external surface of the cabinet comprises a second opening separate from the first opening; the first end of the stub pipe housing comprises an inner diameter adapted for sealed contact with the external surface of the cabinet relative to one or more of the first opening and the second opening; and the first end, the non-permeable inner surface, and the second end are configured to direct fluid escaping the connection to one or more of the first opening and the second opening in the external surface.

3. The stub pipe housing of claim 1, wherein the non-permeable inner surface comprises an elastomeric material.

4. The stub pipe housing of claim 1, wherein: the second end comprises a compliant seal; and the sealed contact between the first end and the cabinet, the sealed contact between the compliant seal and the external pipe, and the non-permeable inner surface of the stub pipe housing are configured to direct fluid escaping the connection into an opening in the cabinet.

5. The stub pipe housing of claim 4, wherein: the stub pipe housing comprises a rigid material; and the stub pipe housing prevents bending at the connection between the stub pipe and the external pipe.

6. The stub pipe housing of claim 1, wherein: sealed contact between the stub pipe housing and the cabinet comprises contact between the outward protrusion of the flange and an external surface of the cabinet.

7. The stub pipe housing of claim 6, wherein: the sealed contact between the flange and the cabinet comprises a seal positioned in the stub pipe opening and the edge of the flange seated in the seal, wherein the sealed contact between the flange and the cabinet, the sealed contact between the second end and the external pipe, and the non-permeable inner surface of the stub pipe housing are configured to direct fluid escaping the connection into the opening in the cabinet.

8. A method for directing fluid escaping a connection between an external pipe and a stub pipe to a cabinet in an HVAC system, the method comprising:

positioning a stub pipe housing on the external pipe, wherein the stub pipe housing comprises an inner diameter greater than at least an opening for a stub pipe extending from the cabinet and a second end adapted for contact with the external pipe;

forming a connection between the external pipe and the stub pipe;

forming a sealed contact between the first end of the stub pipe housing and the cabinet, wherein the first end of the stub pipe housing comprises a flange extending radially outward operable to connect the stub pipe housing to the cabinet, the flange comprising an outward protrusion abutting the cabinet; and directing fluid escaping the connection into the opening in the cabinet, wherein the fluid is directed into the opening through a volume defined by the external pipe connected to the stub pipe, the non-permeable inner surface, and the sealed contact between the second end and the external pipe, the opening of the cabinet allowing for fluid communication between the interior of the cabinet and the volume, wherein at least a portion of the volume is between the external pipe and the stub pipe housing.

9. The method of claim 8, wherein the non-permeable material comprises an elastomeric material.

10. The method of claim 8, wherein: configuring the stub pipe housing for sealed contact with the external pipe comprises one of positioning the second end on the external pipe, wherein the second end of the stub pipe housing comprises a compliant seal; and the sealed contact between the first end and the cabinet, the sealed contact between the compliant seal and the external pipe, and the non-permeable inner surface of the stub pipe housing are configured to direct fluid escaping the connection into an opening in the cabinet.

11. The method of claim 10, wherein: the stub pipe housing comprises a rigid material; and the stub pipe housing prevents bending at the connection between the stub pipe and the external pipe.

12. The method of claim 8, further comprising: positioning a seal on an external surface of the cabinet; and seating the outward protrusion of the flange in the seal.

13. The method of claim 12, further comprising: wherein the sealed contact between the flange and the cabinet, the sealed contact between the second end and the external pipe, and the non-permeable inner surface of the stub pipe housing are configured to direct fluid escaping the connection into the opening in the cabinet.

14. An HVAC system, comprising:

a compressor, an evaporator, and a condenser forming a refrigeration cycle;

a plurality of fluid lines coupled to the compressor, the evaporator, and the condenser, wherein each connection between a fluid line and one of the compressor, the evaporator, and the condenser represents a point at which fluid can escape the HVAC system; and a stub pipe housing for directing fluid escaping each connection to a cabinet having a fluid detection sensor, wherein the stub pipe housing comprises:

a first end for sealed contact with the cabinet, wherein the first end comprises an inner diameter greater than at least an opening for a stub pipe extending from the cabinet, wherein the first end of the stub pipe housing comprises a flange extending radially outward operable to connect the stub pipe housing to the cabinet, the flange comprising an outward protrusion abutting the cabinet;

a second end configured for sealed contact with an external pipe connected to the stub pipe; and a non-permeable inner surface formed between the first end and the second end; and wherein the external pipe connected to the stub pipe, the non-permeable inner surface, and the sealed contact between the second end and the external pipe define a volume for directing fluid escaping the connection into the opening in the cabinet, the opening of the cabinet allowing for fluid communication between the interior of the cabinet and the volume, wherein at least a portion of the volume is between the external pipe and the stub pipe housing.

15. The HVAC system of claim 14, wherein the non-permeable inner surface comprises an elastomeric material.

16. The HVAC system of claim 14, wherein: the second end comprises a compliant seal; and the sealed contact between the first end and the cabinet, the sealed contact between the compliant seal and the external pipe, and the non-permeable inner surface of the stub pipe housing are configured to direct fluid escaping the connection into an opening in the cabinet.

17. The HVAC system of claim 16, wherein: the stub pipe housing comprises a rigid material; and coupling the second end of the stub pipe housing to an external pipe prevents bending at the connection between the stub pipe and the external pipe.

18. The HVAC system of claim 14, wherein: sealed contact between the stub pipe housing and the cabinet comprises contact between the outward protrusion of the flange and an external surface of the cabinet.

19. The HVAC system of claim 18, wherein: the sealed contact between the flange and the cabinet comprises a seal positioned in the stub pipe opening and the edge of the flange seated in the seal, wherein the sealed contact between the flange and the cabinet, the sealed contact between the second end and the external pipe, and the non-permeable inner surface of the stub pipe housing are configured to direct fluid escaping the connection into the opening in the cabinet.

* * * * *